United States Patent [19]

Gay et al.

[11] Patent Number: 4,764,260

[45] Date of Patent: Aug. 16, 1988

[54] PROCESS FOR ELECTROPLATING NICKEL OVER STAINLESS STEEL

[76] Inventors: Ronald N. Gay, 6431 E. Palmer, Detroit, Mich. 48211; Wayne K. Raymond, 29700 Bristol La., Birmingham, Mich. 48010

[21] Appl. No.: 38,733

[22] Filed: Apr. 15, 1987

[51] Int. Cl.[4] ..... C25D 5/26

[52] U.S. Cl. ..... 204/34; 204/29

[58] Field of Search ..... 204/34, 29

[56] References Cited

U.S. PATENT DOCUMENTS

| | | | |
|---|---|---|---|
| 3,247,086 | 4/1966 | Goldstein et al. | 204/34 |
| 4,412,892 | 11/1983 | Chen et al. | 204/34 |
| 4,664,759 | 5/1987 | Chessin | 204/34 |

*Primary Examiner*—John F. Niebling
*Assistant Examiner*—William T. Leader
*Attorney, Agent, or Firm*—Cullen, Sloman, Cantor, Grauer, Scott and Rutherford

[57] ABSTRACT

In a process for plating nickel upon a surface of a workpiece made of stainless steel, the workpiece is immersed in an electrolytic sulfuric acid bath, with the workpiece anodically connected. Thus, DC current flows from the workpiece, through the bath, to a separate cathode in the bath. Thereafter, the sulfuric acid is rinsed from the workpiece and the workpiece surface is electroplated with nickel which will strongly adhere to the surface. Finally, the nickel-plated part may be conventionally electroplated with chrome.

9 Claims, 1 Drawing Sheet

PROCESS FOR ELECTROPLATING NICKEL OVER STAINLESS STEEL

BACKGROUND OF INVENTION

It is common practice to chrome plate many different types of industrial parts which are made of stainless steel in order to give the parts a bright, shiny surface. By way of example, automotive vehicle body moldings, door handles, and other functional or decorative parts are chrome-plated for appearance purposes. Frequently, such parts are made of stainless steel to prevent rusting.

In commercial practice, chrome plating stainless steel parts typically is accomplished by initially buffing the stainless steel to achieve a high luster and then electroplating with chromium to retain the high luster and to make the finished surface more durable. In the past, stainless steel parts have been electroplated with nickel before the chromium electrolytic plating step. But, the adhesion between the nickel plating and the steel part has been erratic. Further, the red rust resistance of the nickel plated part has been erratic.

It has been understood by those skilled in the art that proper adhesion and good red rust resistance could not be consistently achieved when electroplating nickel over stainless steel. Particularly, conventional pre-plating surface treatment followed by conventional plating has not been effective in producing sufficient chemical bond between the stainless steel surface and the nickel coating. This has been especially true in the case of bright annealed stainless steel. Thus, there has been a need for a process to strongly adhere nickel plating to an annealed stainless steel workpiece and to maintain red rust resistance of the plated part.

This invention relates to an improvement in the nickel-plating process and, more particularly, in the electrolytic acid surface-treating step used in the process of nickel plating stainless steel, which causes the plating to better adhere to the stainless steel while, simultaneously, not destroying the red rust resistance of the stainless steel surface.

SUMMARY OF INVENTION

The invention herein contemplates an improvement in the conventional, nickel-chrome plating process for plating stainless steel workpieces wherein the pre-plating, electrolytic sulfuric acid surface treatment step is performed with the workpiece connected as an anode in the electrolytic bath circuit. That is, current flows from the work pieces, through the bath to a separate cathode, during the time that the surfaces are subjected to the electrolytic acid bath. Thereafter, the sulfuric acid is rinsed away, and the nickel plating and chrome plating are applied in the conventional manner.

We have discovered that by connecting the workpieces anodically in the electrolytic acid bath, there is a marked improvement in the adherence between the nickel plating to the surface of a workpiece or part made of bright, annealed stainless steel. This adherence is unexpected and contrary to the normal understanding of the art that the part, under electrolytic acidic exposure, should be cathodic or neutral in the electrical system. That is, we have discovered that by reversing the flow of electrons, namely by flowing them away from the part rather than to the part, the surface is remarkably activated to strongly adhere to the subsequently applied nickel plating.

An object of this invention is to produce good, commercial nickel-chrome plating of stainless steel, and especially bright, annealed stainless steel, which previously could not be satisfactorily plated because the nickel did not consistently adhere to the surface of such metal.

A further object of this invention is to enable the application of a conventional nickel-chrome electroplating procedure to be used for chrome-plating bright, annealed stainless steel without materially changing the conventional procedure or increasing the expense of operating it. That is, by reversing the flow of current in the electrolytic circuit so that the current flows to the anodically-connected workpieces, without otherwise changing the procedural steps or the equipment, it becomes commercially feasible to produce strongly adhering nickel plating upon annealed stainless steel parts.

A further object of this invention is to improve the process for electroplating nickel upon the surface of a part made of annealed stainless steel while not adversely affecting or destroying the red rust resistance of the stainless steel. By this process, the part retains, and may even have improved, resistance to red rust, i.e., iron oxide formation.

These and other objects and advantages of this invention will become apparent upon reading the following disclosure, of which the attached drawings form a part.

DETAILED DESCRIPTION

Figure 1:
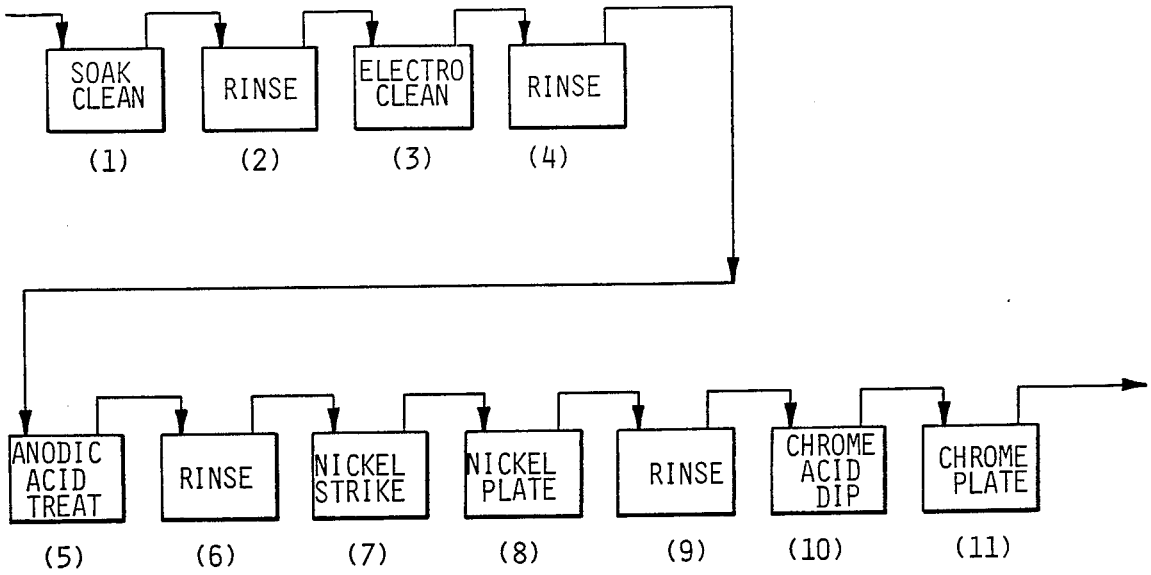
FIG. 1 is a simplified, schematic flow chart showing the sequence of essential steps in the electroplating process.

FIG. 1 schematically illustrates the successive steps, in chrome plating a stainless steel workpiece or part. The process begins with several, successive steps for cleaning the surface of the part. Such cleaning includes removal of scale, oil, grease and other foreign material.

Initially, either a single part, or a collection of parts in a basket or supported upon a plating rack, is placed within a soak bath (see step (1), in FIG. 1). An example of such a soak is a material known as Soak Cleaner, No. 613, a proprietary product of MacDermid, which contains a mixture of sodium hydroxide (NaOH), sodium orthophosphate ($NaH_2PO_4H_2O$), sodium polyphosphate ($Na_2PO_4.12H_2O$), sodium silicate ($Na_2SiO_4$), sodium carbonate ($Na_2CO_3$), an organic emulsifier and a resin-type soap with a synthetic wetting agent. This particular soak cleaner is used at a temperature of about 190°-200° F., in a concentrate of 8-10 ounces per gallon, with moderate air agitation, at a pH of 12-14. The parts may be immersed for four to six minutes, for example.

After the soak cleaner step, the part or parts, assuming a number are loaded in a basket or upon a rack, are rinsed in a clear water rinse step. (see step (2)). The parts are again cleaned in an electrocleaning step (3).

By way of example, a suitable electro-cleaner bath is commercially sold under the name of Anodex, a proprietary material marketed by MacDermid. The electro-cleaner bath is typically operated at a temperature of about 195°-200° F. with a concentration of 6-8 ounces per gallon and a pH of 12-14. The parts are immersed for between about 5-15 seconds with a current density of 40-50 amps per square foot or 4.3-5.4 amps per square meter, with the parts maintained at an anodic polarity with a voltage of approximately 5-6 volts. The electro-cleaner generally is a solution of sodium hydroxide (NaOH), sodium carbonate ($Na_2CO_3$), sodium triphosphate ($Na_2PO_4.12H_2O$), and sodium metasilicate ($Na_2SiO_3$).

Next, as indicated by step (4), the parts are rinsed in clear water one or two times. Other cleaning steps may also be incorporated, but the foregoing were illustrated as examples of typical cleaning steps used in this kind of process. Likewise the cleaning materials may be varied, depending upon commercial availability, nature of cleaning required etc.

Stainless steel surfaces resist corrosive elements because of a thin film of oxides formed on them. This film can be stripped off or penetrated, but immediately reforms to protect the stainless steel against corrosion. An electroplated deposit of nickel cannot be adhered over the oxide film. Therefore, the film must be removed prior to an electrodeposit, and the electroplating must be done before the film forms again.

In order to remove this film in the past, the stainless steel workpieces have been subjected to a sulfuric acid or other acidic treatment. An electrolytic sulfuric acid bath has been used in the past with the stainless steel parts connected in the circuit as cathodes. That is, the flow of current has been to the parts in the electrolytic bath. However, the adhesion of the nickel to the stainless steel following this treatment has not always been consistent. Particularly in the case of bright, annealed stainless steel, it has not been possible to get good, consistent adhesion of the nickel electroplated coating to the surface of the stainless steel. Thus, the invention herein relates to a change in the sulfuric acid treatment which is illustrated as step (5) in FIG. 1. Essentially, the change involves connecting the workpieces or parts which are made of stainless steel in an anodic condition in the electrolytic circuit.

Figure 2:
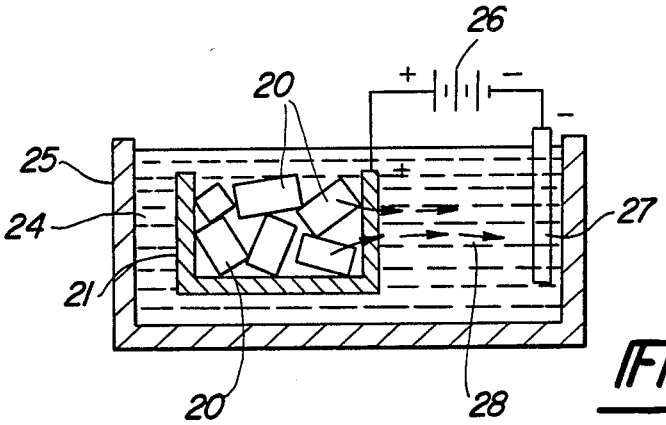
FIG. 2 is a schematic, cross-sectional view showing the immersion of an anodically connected basket containing stainless steel workpieces, within an electrolytic sulfuric acid bath.

Referring to FIG. 2, a number of workpieces or parts 20 are loosely held, in electrically contacting relationship, within a conductive metal, electrolytic-type container or basket 21. The basket, for which a suitable rack could be substituted, is immersed in a bath 24 of a sulfuric acid solution in a suitable container or tank 25.

The parts are connected, through their contact with the metal basket 21, to a DC power source 26 and to a bath cathode 27. The connection to the power source is arranged so that the basket and the contained parts are anodic, as indicated by the plus sign. Thus, the current flows, as indicated by the arrows 28, from the parts to the bath cathode 27. This is the reverse of the normal electrolytic acid bath arrangement previously used.

Figure 3:
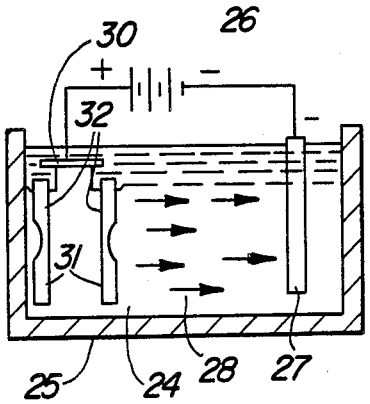
FIG. 3 schematically illustrates a rack carrying a stainless steel part immersed in a sulfuric acid bath.

FIG. 3, schematically illustrates a rack 30 carrying parts 31, e.g. automobile bumpers, suspended from hooks 32. The system is the same whether a basket or a rack is used to support the parts in the bath.

The electrolytic acid treatment step is performed with an industrial grade sulfuric acid of an approximately 10% concentration by volume. Its specific gravity may be in the range of 1.84, and it is formed, for example, with 2.4 ounces per gallon of water or about 18 grams per liter. However, the concentration may be varied, so that the amounts given here are approximate. Trial and error tests are needed to determine the particular concentration best suited for a particular product. Concentration ranges of between about 10-70% may be feasible depending upon operating conditions and the nature of the parts.

The acid is normally maintained at room temperature. The bath is operated at a current density, relative to the surface areas of the parts immersed in the bath, of between about 10-55 amps and preferably between about 45-55 amps per square foot or 4.6-5.9 amps per square meter. The voltage is at approximately 3-4 volts. The bath cathode 27 is preferably formed of chemically pure lead or of carbon. A typical treatment immersion time would be between about 10-30 seconds, but may be shortened or lengthened depending upon the nature of theparts to between about 5-90 seconds. The actual time is not critical; optimum times can be determined for a particular part through trial and error.

The purpose of the acid treatment is to remove the oxide film and to activate the plating surface for the reception of the nickel plating. Thus, there is a range of variations of acid concentration, time, current density, voltage and the like within which reasonably optimum results can be obtained for different parts.

Following the acid treatment, the parts are water rinsed, as illustrated by step (6). Thereafter, the parts are subjected to an acid-nickel or "Woods" nickel strike electrolytic bath (see step (7)). This involves immersing the parts in an acid-nickel chloride solution containing hydrochloric acid for about 1½-2 minutes at a temperature between about room temperature to 90° F. The bath may be operated at current densities of about 15-20 amps per square foot of part surface area at a voltage of approximately 3-4 volts, using electrolytic nickel anodes. The concentration of the nickel chloride and the hydrochloric acids may be varied, but it has been found that good results are obtained when the nickel chloride is in the range of about 32 ounces per gallon and the hydrochloric acid is in the range of about 16 ounces per gallon in the solution.

After the nickel strike step, the parts are placed in a bright nickel plating bath, which is illustrated as step (8). Commercially available proprietary bath ingredients are used for this purpose. An example is a proprietary bright nickel bath which is commercially available from McGean-Rohoco. This contains single nickel salts ($NiSO_4$ $6H_2O$) at about 18-24 ounces per gallon, nickel chloride ($NiCl_2$ $6H_2O$) in the range of 16-18 ounces per gallon, and boric acid ($H_3BO_3$)in the range of 6-7 ounces per gallon. This bath, operated at 3.6-4.0 pH, and at a temperature of between about 140°-145° F. (60°-66° C.), receives the parts for about fifteen minutes. The current densities are between about 40-45 amps per square foot of surface area of the parts (4.32-4.86 amps per square meter) with a voltage of between 6-7 volts. This provides the smooth bright nickel plating upon the surface of the parts.

Following the nickel plating, the parts may be water rinsed, as shown in step (9), one or two times. At this point, the parts each have a nickel coating that is firmly and strongly adhered to its surface, as a result of the anodic acid treatment.

Next, the nickel-coated parts are immersed in a chromic acid pre-plating dip (see step (10)). The chromic acid salts ($CrO_3$) may be in a concentration of about ½-3 ounces per gallon. The dip, operated at room temperature, receives the parts for between about 15–30 seconds.

After the dip, the parts are immersed in an electrolytic chrome plate bath as shown in step (11). Various chrome-plating baths are commercially available. One suitable bath, which is proprietary to McGean-Rohoco, contains chromic acid salts ($CrO_3$) of between about 40–42 ounces per gallon, sulfuric acid ($SO_4$) at about 0.22 ounces per gallon, in the ratio of 170–190:1. The bath may be operated at a temperature of about 112°–116° F. (40° C.–44° C.).

Typically, in the chrome plating, a current density of approximately 150 amps per square foot, at about 5 to 9 volts, is utilized.

Following the chrome plating, the plated parts may be repeatedly rinsed in clear cold tap water and in hot water. Then the parts are dried either by air-drying or by a suitable dryer to complete the plating procedure.

The present process is operative with different stainless steels and is especially useful for bright, annealed stainless steels. Examples of commercially available stainless steels for which this process is applicable are types 201 (UNS-S20100), 301 (UNS-S30100), 304 (UNS-S30400), 430 (UNS-S43000) and 434 (UNS-S43400).

The plating process, including the various steps and materials utilized for each of the steps, may be varied. Typically, experience or trial and error testing are needed to determine the optimum operation and materials for each step. Thus, it is contemplated that this invention may be further developed within the scope of the following attached claims to achieve the intended purpose.

Having fully described an operative embodiment of this invention, we now claim:

1. A process for electroplating a stainless steel part comprising essentially the steps of:

(a) cleaning the surface of the part;

(b) treating the surface of the part by immersing it in an electrolytic bath, sid electrolytic bath consisting of sulfuric acid, the concentration of said sulfuric acid being about 10% by volume, with the part connected to be anodic, such that DC current flows from the part through the bath to a separate cathode in the electrolytic bath;

(c) rinsing the sulfuric acid off the part;

(d) electroplating nickel upon the surface of the part by immersing it in an electrolytic, nickel solution; whereby the nickel plating will strongly adhere to the surface of the part without destroying the red rust resistance of the stainless steel part.

2. A process as defined in claim 1, and with the current density, during the surface-treating step, being between about 45–55 amps per square foot, with the voltage between about 3–4 volts.

3. A process as defined in claim 2, and with the surface treatment applied to the part for between about 5–90 seconds.

4. A process as defined in claim 2, and with the surface treatment applied to the part for between about 10–30 seconds.

5. A process as defined in claim 1, and with the nickel electroplating including first applying a nickel strike to the surface of the part by immersing it in acid nickel chloride, i.e. a Woods nickel strike bath, and thereafter, electroplating the part in a bright nickel bath.

6. A process as defined in claim 5, and including the step of chrome plating the part following nickel plating the part.

7. In a process for electroplating a stainless steel workpiece, including essentially the steps of cleaning the workpiece, surface-treating the workpiece by immersing it in an electrolytic bath, electroplating the surface of the workpiece with nickel, and electroplating a chrome plating upon the nickel-plated workpiece, the improvement comprising:

in the electrolytic bath surface-treating step, applying a DC electrical current to the workpiece while the workpiece is immersed in the electrolytic bath consisting of sulfuric acid having a concentration of about 10% by volume, with the workpiece being anodically connected so that current flows from the workpiece, through the electrolytic bath, to a separate cathode in the electrolytic bath;

whereby the nickel plating will strongly adhere upon the surface of the workpiece which is made of a bright, annealed stainless steel so that the workpiece may be nickel-chrome plated and wherein the process does not substantially adversely affect the red rust resistance of the stainless steel.

8. In a process as defined in claim 7, and wherein the density of the electrical current is roughly between about 10–55 amps/square foot of workpiece surface, at a voltage of roughly between about 3–4 volts, with the workpiece treated a predetermined time of roughly between 5–90 seconds.

9. In a process as defined in claim 1, and wherein the bath temperature is maintained generally at about room temperature.

* * * * *